US008536968B1

(12) United States Patent
Chang et al.

(10) Patent No.: US 8,536,968 B1
(45) Date of Patent: Sep. 17, 2013

(54) MAGNETIC COMPONENT STRUCTURE

(75) Inventors: Teng-Kang Chang, Jhubei (TW); Chun-Chen Liu, Jhubei (TW)

(73) Assignee: Verticil Electronics Corporation, Hsinchu County (TW)

( * ) Notice: Subject to any disclaimer, the term of this patent is extended or adjusted under 35 U.S.C. 154(b) by 0 days.

(21) Appl. No.: 13/600,819

(22) Filed: Aug. 31, 2012

(30) Foreign Application Priority Data

Mar. 2, 2012 (TW) ..... 101203731 U

(51) Int. Cl.
*H01F 27/30* (2006.01)
*H01F 27/29* (2006.01)
*H01F 27/24* (2006.01)

(52) U.S. Cl.
USPC ..... 336/198; 336/192; 336/208; 336/212

(58) Field of Classification Search
USPC ..... 336/221, 83, 192, 208, 198, 214, 336/215, 212
See application file for complete search history.

(56) References Cited

U.S. PATENT DOCUMENTS

2010/0026437 A1* 2/2010 Lin et al. ..... 336/192
2010/0156584 A1* 6/2010 Yamaguchi et al. ..... 336/65
2011/0115594 A1* 5/2011 Yen ..... 336/192
2012/0002387 A1* 1/2012 Park et al. ..... 361/760
2012/0212314 A1* 8/2012 Li et al. ..... 336/192

* cited by examiner

*Primary Examiner* — Alexander Talpalatski
*Assistant Examiner* — Mangtin Lian
(74) *Attorney, Agent, or Firm* — Ming Chow; Sinorica, LLC

(57) ABSTRACT

An improved magnetic component structure, wherein the structure comprises a base and two iron cores, in which the base includes a centrally through winding axle tube and the openings at both the left and right ends of the winding axle tube individually extend out a baffle. Additionally, the two iron cores are caps, in which a core column extends out from the center of the iron core toward the opening of the winding axle tube, and the core column can be inserted to the centrally through part of the winding axle tube. Therefore, the two iron cores can be clip installed between the two sets of pin parts of the base and left and right assembled to the base such that the base combined with the two iron cores can be installed upright on one side having the notch of a drive circuit board in an LED light tube.

8 Claims, 5 Drawing Sheets

MAGNETIC COMPONENT STRUCTURE

The current application claims a foreign priority to the patent application of Taiwan No. 101203731 filed on Mar. 2, 2012.

BACKGROUND OF THE INVENTION

1. Field of the Invention

The present invention generally relates to an improved magnetic component structure; in particular, the present invention relates to an improved magnetic component structure enabling installation on one side of a drive circuit board in an LED light tube.

2. Description of Related Art

Currently well-known magnetic components (e.g., inductors, transformers or the like) are ones of the most important electronic components in the electronic product, essentially applied to convert the drive voltage in the electronic circuit and generally characterized as: the magnetic component for voltage buck in a power supply, the high voltage magnetic component for operation voltage boost in a conventional or liquid crystal display, etc. The manufacturers of electronic products may select magnetic components of appropriate specifications or types in accordance with their requirements such that the voltage transformation processes can demonstrate required stability and good operation performance.

However, the magnetic components commonly installed on a drive circuit board in an LED lamp tube mostly include a fixed iron core with windings wound thereon. That is also the reason why the magnetic components are usually directly soldered onto one side of the circuit board, and such magnetic components are typically the electronic components occupying the largest area on the circuit board, in particular for the configuration comprising large-sized magnetic components. With regards to the development trend for modern electronic devices featuring miniature or smaller and slimmer profiles, such large-sized magnetic components, in addition to excessive space occupation, restrict the possibility for device size reduction as well.

Therefore, it would be an optimal solution if the magnetic component can be installed on either side of the circuit board thereby reducing the space occupied by the magnetic component.

SUMMARY OF THE INVENTION

As such, the present invention provides an improved magnetic component structure allowing installation on either side of a drive circuit board in an LED lamp tube thereby reducing the space occupied by the combination of the magnetic component with the circuit board.

An improved magnetic component structure capable of achieving the aforementioned innovative objectives comprises a base and two iron cores, in which the base includes a centrally through winding axle tube and the openings at both the left and right ends of the winding axle tube individually extend out a baffle, with two sets of pin parts being symmetrically installed at the outer edge on each of the baffles, and at least an upward or downward pin extending out from the pin part. Moreover, the two iron cores are caps, in which two notches are symmetrically installed on such iron cores and two symmetrical round walls extend out toward the base. Meanwhile, between the two round walls, a core column extends out at the center of the iron core toward the opening of the winding axle tube.

Accordingly, the two iron cores can be clip installed between the two sets of pin parts of the base and left and right assembled onto the base such that the round walls of the two iron cores can mutually match and wrap the base, and the core column can be inserted to the centrally through part of the winding axle tube.

More specifically, the shape of the aforementioned core column matches the centrally through part of the winding axle tube.

More specifically, the pins of the aforementioned pin part are used for connection in insertion to a circuit board.

More specifically, the aforementioned pin part is configured with a clapboard at the outer edge of the baffle, and the notches on the two iron cores can be clip installed between the inner sides of the clapboards on the two sets of pin parts, in which the pins extend outward from the clapboard and form a certain distance from the clapboard.

More specifically, one of the aforementioned two iron cores is disposed on the left side of the base, and the other iron core on the right side of the base.

In addition, the improved magnetic component structure can be installed upright on one side having a notch of a circuit board, wherein the improved magnetic component structure comprises a base and two iron cores, in which the base includes a centrally through winding axle tube and the openings at both the left and right ends of the winding axle tube individually extend out a baffle, with two sets of pin parts being symmetrically installed at the outer edge on each of the baffles, and at least an upward or downward pin extending out from the pin part. Besides, the two iron cores are embodied as caps, in which two notches are symmetrically installed on such iron cores and two symmetrical round walls extend out toward the base, and also, between the two round walls, a core column extends out at the center of the iron core toward the opening of the winding axle tube, and the core column can be inserted to the centrally through part of the winding axle tube.

Therefore, the two iron cores can be clip installed between the two sets of pin parts of the base and left and right assembled to the base such that the round walls of the two iron cores can mutually match and wrap the base, and the pins of the pin part can be inserted to the junction points around the notch such that the base assembled with the two iron cores can be installed upright on one side having the notch of the circuit board.

More specifically, the shape of the aforementioned core column matches the centrally through part of the winding axle tube.

More specifically, the aforementioned pin part is configured with a clapboard at the outer edge of the baffle, and the notches on the two iron cores can be clip installed between the inner sides of the clapboards on the two sets of pin parts, in which the pins extend outward from the clapboard and form a certain distance from the clapboard.

More specifically, one of the aforementioned two iron cores is disposed on the left side of the base, and the other iron core on the right side of the base.

More specifically, the size of the aforementioned base combined with the two iron cores matches the size of the notch on the circuit board such that the improved magnetic component structure can be installed upright on one side having the notch of the circuit board.

DETAILED DESCRIPTION OF THE PREFERRED EMBODIMENTS

The aforementioned and other technical contents, aspects and effects in relation with the present invention can be clearly appreciated through the detailed descriptions concerning the preferred embodiments of the present invention in conjunction with the appended drawings.

Figure 1:
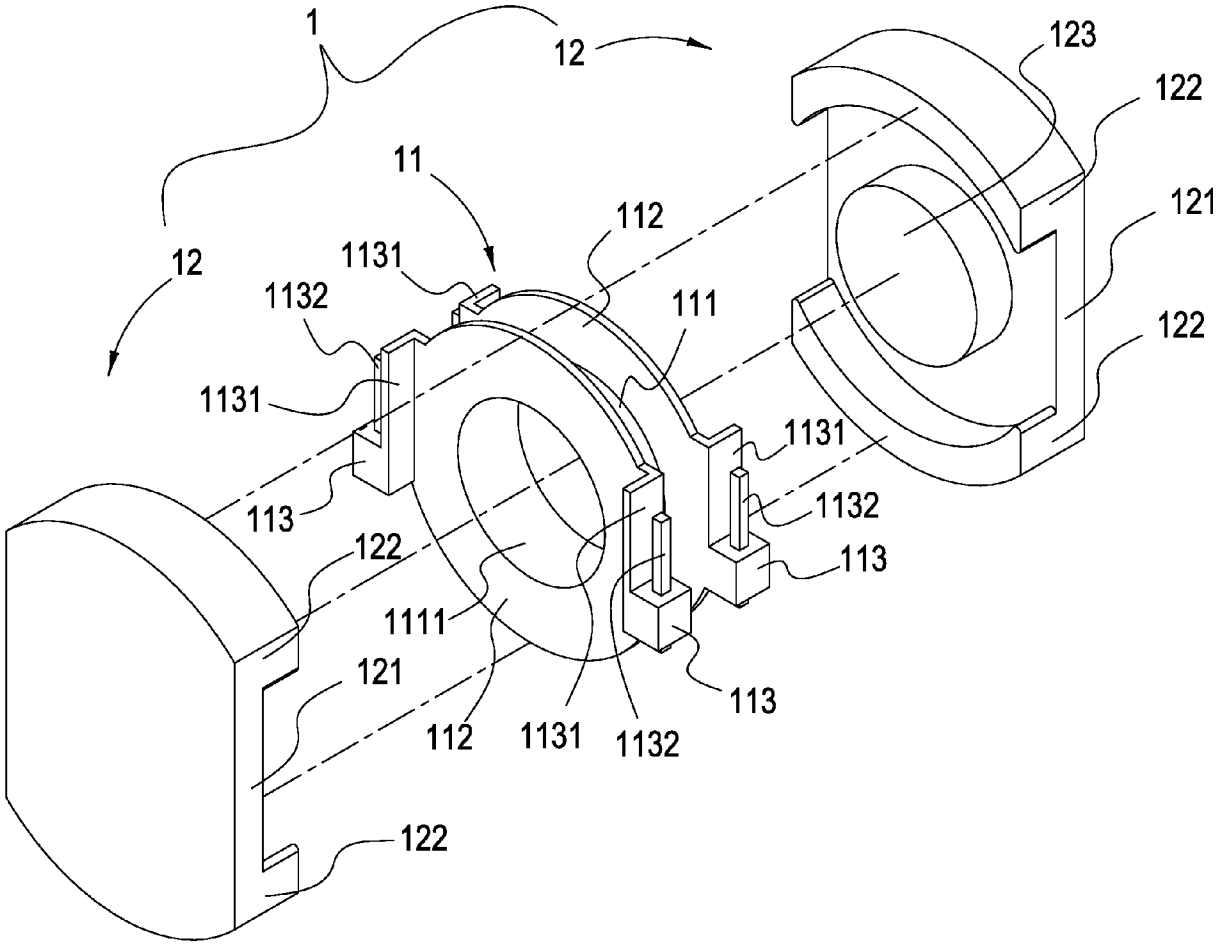
FIG. 1 shows a disassembled structural diagram for the improved magnetic component structure according to the present invention.
Figure 2:
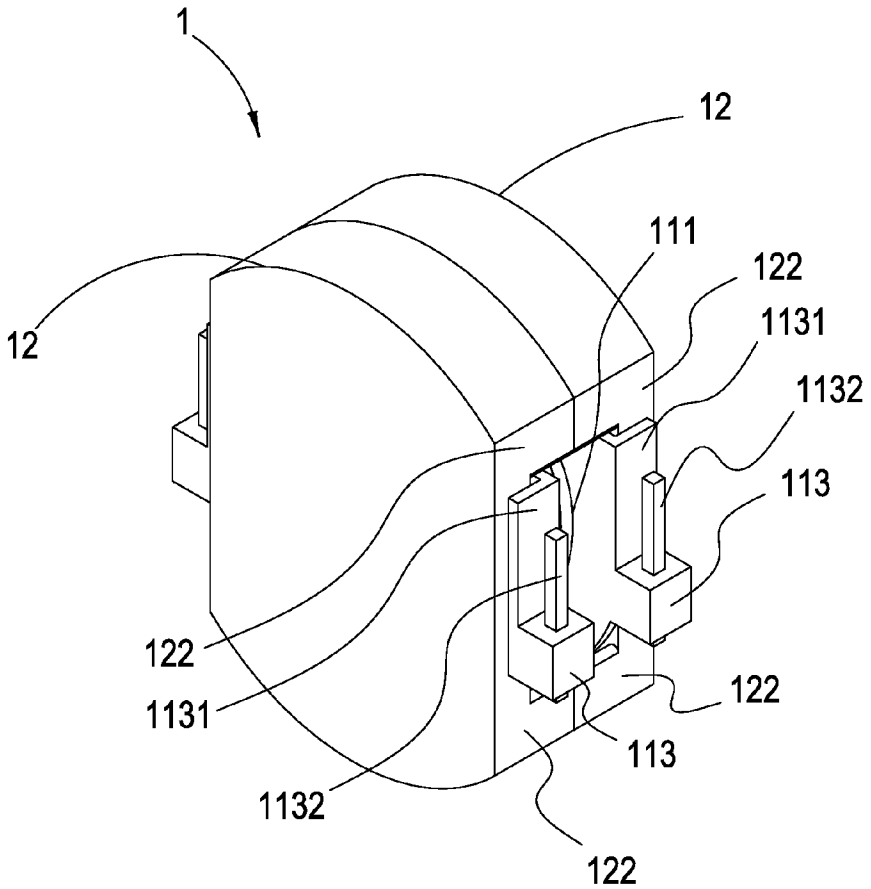
FIG. 2 shows an assembled structural diagram for the improved magnetic component structure according to the present invention.

Refer first to FIGS. 1 and 2, wherein a disassembled structural diagram and an assembled structural diagram for the improved magnetic component structure according to the present invention are respectively shown. It can be seen from the Figures that the improved magnetic component structure 1 comprises a base 11 and two iron cores 12, in which the base 11 is a centrally through winding axle tube 111 and the openings at both the left and right ends of the winding axle tube 111 individually extend out a baffle 112, with two sets of pin parts 113 being symmetrically installed at the outer edge on each of the baffles 112, also in which the pin part 113 is configured with a clapboard 1131 at the outer edge of the baffle 112, at least an upward or downward pin 1132 extends outward from the clapboard 1131, and the pin 1132 and the clapboard 1131 are kept in a certain distance.

Besides, one of the two iron cores 12 is disposed on the left side of the base 11, and the other iron core 12 on the right side of the base 11. Moreover, the two iron cores 12 are embodied as caps, in which two notches 121 are symmetrically installed on such iron cores 12 and two symmetrical round walls 122 extend out toward the base 11, and also, between the two round walls 122, a core column 123 extends out at the center of the iron core 12 toward the opening of the winding axle tube 111, and the core column 123 can be inserted to the centrally through part 1111 of the winding axle tube 111.

Furthermore, since the shape of the core column 123 matches the centrally through part 1111 of the winding axle tube 111, as shown in FIG. 2, the two iron cores 12 can be clip installed between the inner sides of the clapboards 1131 on the two sets of pin parts 113, such that the round walls 122 of the two iron cores 12 can mutually match and wrap the base 11 and the core column 123 can be inserted to the centrally through part 1111 of the winding axle tube 111.

Figure 3:
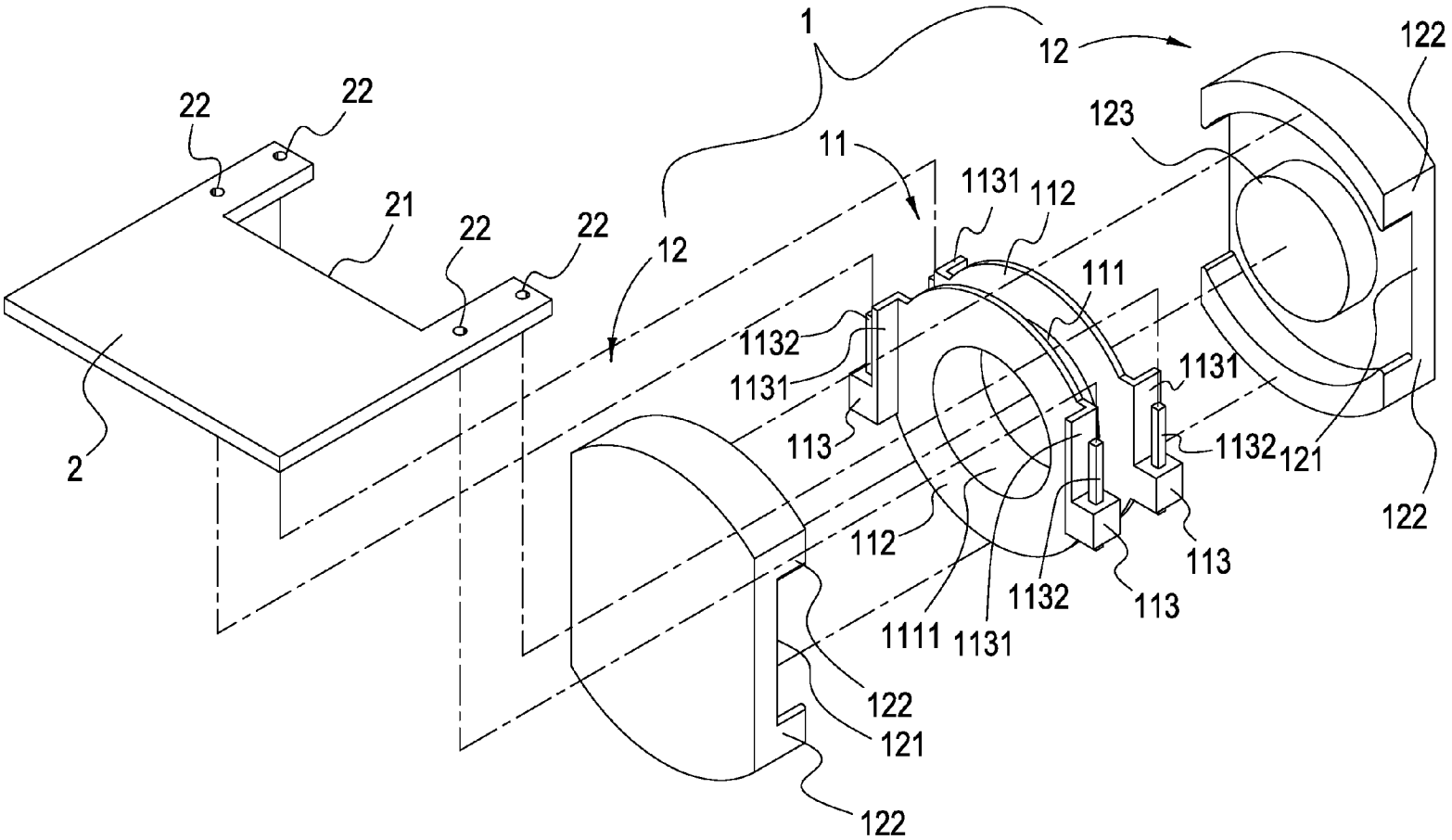
FIG. 3 shows a combination diagram for the improved magnetic component structure according to the present invention with a circuit board.
Figure 4:
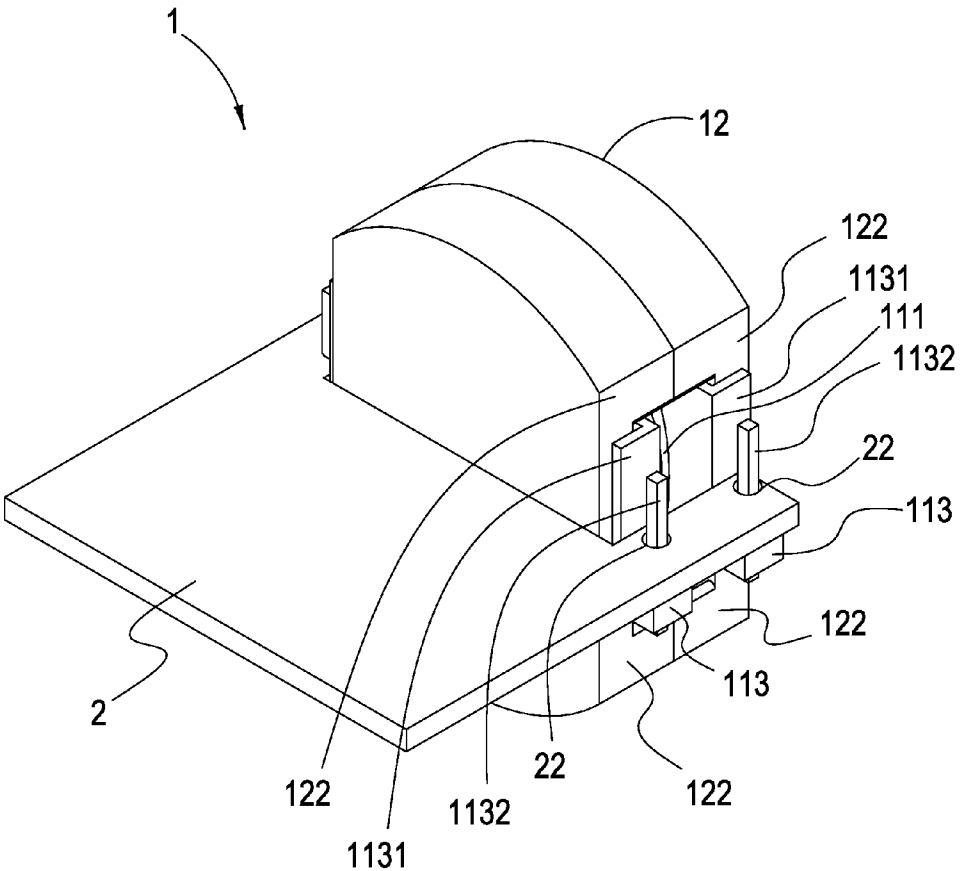
FIG. 4 shows a combination diagram for the improved magnetic component structure according to the present invention with a circuit board.

In addition, because the improved magnetic component structure 1 can be installed on one side of a circuit board 2, as shown in FIGS. 3 and 4, one side of the circuit board 2 needs to have a notch 21 to receive the improved magnetic component structure 1, in which the size of the base 11 combined with the two iron cores 12 has to fit into the size of the notch 21 on the circuit board 2 such that the improved magnetic component structure 1 can be successfully set upright on the side having the notch 21 of the circuit board 2.

Meanwhile, at least a pin 1132 extends outward from the clapboard 1131, as shown in FIGS. 3 and 4, and a plurality of junction points 22 are also configured around the notch 21 of the circuit board 2. As shown in the Figures, the pin 1132 of the pin part 113 is set in insertion from bottom to top onto the junction point 22 around the notch 21, and the base 11 combined with the two iron cores 12 can be installed upright on the notch 21 of the circuit board 2 so as to reduce the space occupied by the improved magnetic component structure 1 combined with the circuit board 2.

Figure 5:
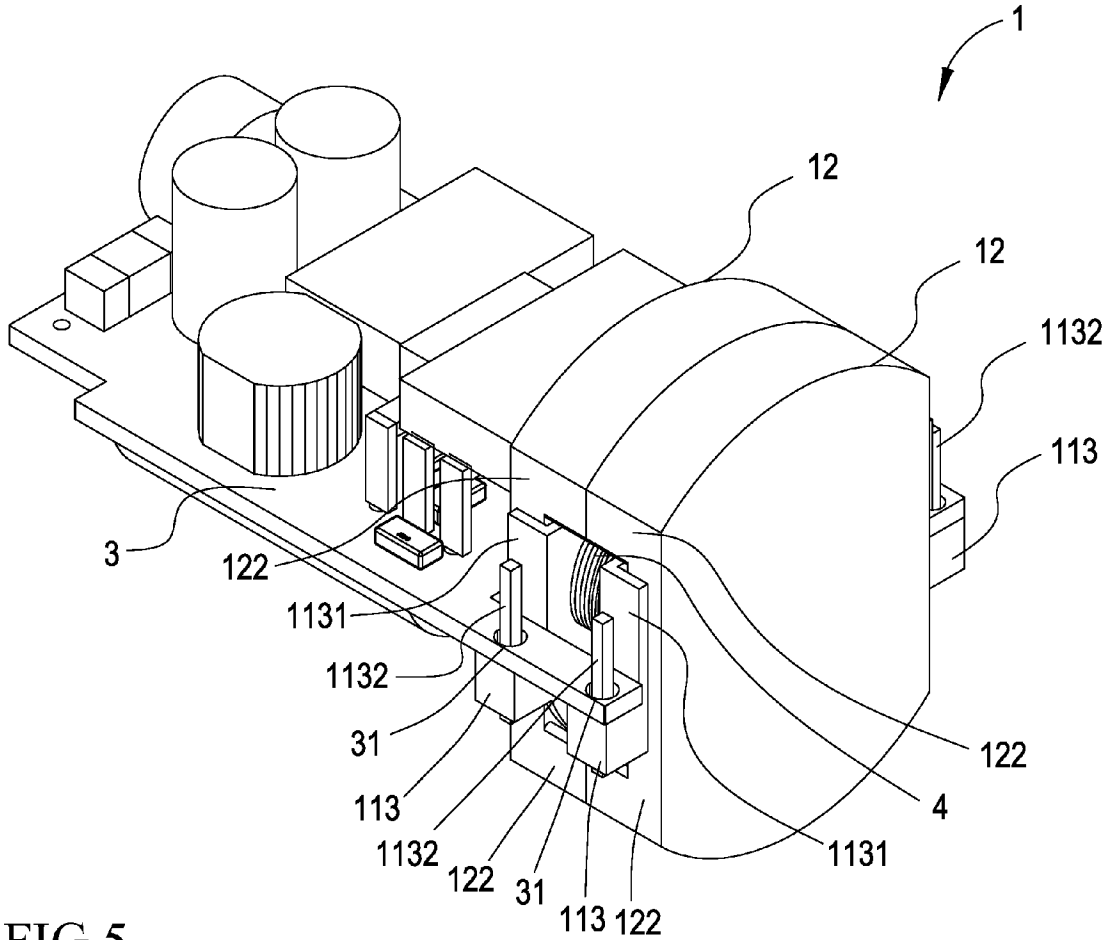
FIG. 5 shows an implementation diagram for the improved magnetic component structure according to the present invention.

In practice, an embodiment for the improved magnetic component structure 1 combined with a drive circuit board 3 in an LED lamp tube can be shown in FIG. 5. Herein a copper wire 4 is wound around the winding axle tube 111 to form a coil, and the wound copper wire 4 can be pulled out and soldered onto four pin parts 113. Therefore, when the pin 1132 of the pin part 113 is set in insertion from bottom to top to the junction point 31 of the circuit board 3 and soldered onto the junction point 31 of the circuit board 3, electrical power can be transferred to the coil by way of the pin part 1132 and the circuit board 3 and the electro-magnetic field can be created by the round wall 122 and the core column 123, thereby causing the improved magnetic component structure 1 to operate.

Besides, it should be noted that, although the pin 1132 in the present invention is set in insertion from bottom to top onto the junction point 22, 31 of the circuit board 2, 3, in practice, the same objectives and effects illustrated in the previous descriptions can be still achieved in case of setting in insertion onto the junction point 22, 31 of the circuit board 2, 3 from the top of the circuit board 2, 3.

Compared with prior art, the improved magnetic component structure provided by the present invention further offers the following advantages:

1. The present invention can be installed on either side of a drive circuit board in an LED lamp tube so the space occupied by the magnetic components combined with the circuit board can be effectively reduced thereby minimizing the size of the applied electronic device or more efficiently utilizing the space inside the electronic device.

By way of the aforementioned detailed descriptions for the preferred embodiments according to the present invention, it is intended to better illustrate the characters and spirit of the present invention rather than restricting the scope of the present invention to the preferred embodiments disclosed in the previous texts. Contrarily, the objective is to encompass all changes and effectively equivalent arrangements within the scope of the present invention as delineated in the following claims of the present application.

What is claimed is:

1. An improved magnetic component structure, comprising:

a base having a centrally through winding axle tube, the centrally through winding axle tube having two openings and a center point, a baffle disposed at each of the two openings, the baffle having a first surface and a second surface, the first surface of the baffle connected to one of the two openings, two clapboards symmetrically and vertically disposed at the outer edge of the second surface of the baffle, the two clapboards disposed at two corresponding sides of the center point respectively, each of the two clapboards having a first long side, a second long side, a first short side, and a second short side, the first long side paralleling the second long side, the first long side connected to the baffle, the first short side paralleling the second short side, a pin part disposed at the second short side of each of the two clapboards, and at least one pin extending out from the pin part toward the first short side, the pin is in a straight form with no curve and extends in a direction parallel to the clapboards;

two iron cores, embodied as caps, two notches symmetrically installed on the iron cores and two symmetrical round walls extending out toward the base, and, between the two round walls, a core column extending out at the center of the iron core toward the two opening of the winding axle tube;

the two iron cores can be clip installed between the two clapboards of the base and left and right assembled onto the base such that the round walls of the two iron cores can mutually match and wrap the base, and the core column can be inserted to the centrally through part of the winding axle tube;

the improved magnetic component structure being installed at one side of a circuit board; and the circuit board comprising two surfaces and four sides.

2. The improved magnetic component structure according to claim 1, wherein the shape of the core column matches the centrally through part of the winding axle tube.

3. The improved magnetic component structure according to claim 1, wherein the pins of the pin part are used for connection in insertion to a circuit board.

4. The improved magnetic component structure according to claim 1, wherein one of the two iron cores is disposed on the left side of the base, and the other iron core on the right side of the base.

5. An improved magnetic component structure, installed vertically at a notch of a circuit board, the notch disposed at one side of the circuit board, wherein the improved magnetic component structure comprises:

a base having a centrally through winding axle tube, the centrally through winding axle tube having two openings and a center point, a baffle disposed at each of the two openings, the baffle having a first surface and a second surface, the first surface of the baffle connected to one of the two openings, two clapboards symmetrically and vertically disposed at the outer edge of the second surface of the baffle, the two clapboards disposed at two corresponding sides of the center point respectively, each of the two clapboards having a first long side, a second long side, a first short side, and a second short side, the first long side paralleling the second long side, the first long side connected to the baffle, the first short side paralleling the second short side, a pin part disposed at the second short side of each of the two clapboards, and at least one pin extending out from the pin part toward the first short side, the pin is in a straight form with no curve and extends in a direction parallel to the clapboards;

two iron cores, embodied as caps, two notches symmetrically installed on the iron cores and two symmetrical round walls extending out toward the base, and, between the two round walls, a core column extending out at the center of the iron core toward the two opening of the winding axle tube, and the core column can be inserted to the centrally through part of the winding axle tube;

the two iron cores can be clip installed between the two clapboards of the base and left and right assembled to the base such that the round walls of the two iron cores can mutually match and wrap the base, and the pins of the pin part can be inserted to at least one junction point around the notch such that the base assembled with the two iron cores can be installed vertically at the notch of the circuit board;

the improved magnetic component structure being installed at one side of the circuit board; and the circuit board comprising two surfaces and four sides.

6. The improved magnetic component structure according to claim 5, wherein the shape of the core column matches the centrally through part of the winding axle tube.

7. The improved magnetic component structure according to claim 5, wherein one of the two iron cores is disposed on the left side of the base, and the other iron core on the right side of the base.

8. The improved magnetic component structure according to claim 5, wherein size of the base combined with the two iron cores matches the size of the notch on the circuit board such that the improved magnetic component structure can be installed upright on one side having the notch of the circuit board.

* * * * *